US005463925A

United States Patent [19]

Galocy

[11] Patent Number: 5,463,925

[45] Date of Patent: Nov. 7, 1995

[54] SPLIT-KEYBOARD MIDI CONTROLLER

[76] Inventor: Baran Galocy, 12171 Cinder Rd., Redding, Calif. 96003

[21] Appl. No.: 147,327

[22] Filed: Nov. 2, 1993

[51] Int. Cl.[6] ..... G10C 3/12

[52] U.S. Cl. ..... 84/423 R; 84/DIG. 3; 400/682

[58] Field of Search ..... 84/423 R, 432, 84/429, DIG. 3; 400/82, 489, 682

[56] References Cited

U.S. PATENT DOCUMENTS

| | | | |
|---|---|---|---|
| 971,172 | 9/1910 | Clutsam | 84/423 R |
| 3,478,159 | 1/1992 | Olson | 84/719 |
| 3,541,912 | 11/1970 | Radke | 84/719 |
| 5,065,662 | 10/1993 | Hacker | 84/719 |
| 5,067,832 | 11/1991 | Szmanda et al. | 400/489 |
| 5,099,737 | 3/1992 | Curlette | 84/376 R |
| 5,267,127 | 11/1993 | Pollitt | 400/682 X |

*Primary Examiner*—David M. Gray
*Assistant Examiner*—Patrick J. Stanzione

[57] ABSTRACT

An electronic music keyboard that folds in the middle bottom-to-bottom, and pivots in the middle, back-to-back. When fully open along both planes, the keyboard looks and performs in a conventional manner. When partially pivoted, the keyboard may be supported by an ergonomic belt, or standard means and played hanging from the body of the operator forming an adjustable, inverted "V" shape on a vertical axis. When fully pivoted, the keyboard may be worn over the chest of the operator and played much like a double-keyboard accordian. The ends form a carrying handle and the keyboard folds neatly into a carry bag. This device may also be fabricated from appropriate materials to act as a support for prior art small MIDI keyboards.

14 Claims, 3 Drawing Sheets

SPLIT-KEYBOARD MIDI CONTROLLER

BACKGROUND—FIELD OF THE INVENTION

The present invention relates to an electronic-music-controller keyboard that splits in the middle, with the ends pivoting away from an operator, and hangs on an ergonomic belt from the hips and waist of the operator. The present invention also folds in half for portability and stowage.

BACKGROUND—DESCRIPTION OF PRIOR ART

At the present time, there is not a convenient way for a keyboard player to step in front of the keyboard rack and engage an audience the way a guitar player can, due to the encumberences imposed by the equipment available upon the market. Several patents have addressed this issue but not without, in some way, limiting the means of performance.

For example, U.S. Pat. No. 3,541,912 addresses this need but does so in a limiting manner by restricting the operator to use one hand on the keyboard and one hand on the control area, the device being similar in shape to a guitar. This device is now duplicated by several manufacturers with modern technology and said limitations.

More recently, U.S. Pat. No. 5,065,661 approched this problem with a portable arm-mounted keyboard wired to a shoulder worn power/sound module. This design is even more restricting to a performer, subjecting him or her to arm fatigue and bad body posture. The shoulder mounted pack addresses mobility, but the configuration limits performance application.

U.S. Pat. No. 5,099,737 addresses portability, and the design characteristics enhance performance since both hands may be used to make music. The drawback is that this invention mimics an accordian in design and function, thus one,must be proficient playing the accordian before this instrument is mastered.

U.S. Pat. Pending No. 9,123,510 also addresses portability in a lightweight design. It can be battery powered to free it from a power cord, but it is only two octaves long. It also has only two screw-mount posts to allow support on a strap. Unfortunately, this device is ungainly and moves about, and the strap impedes performance.

OBJECTS AND ADVANTAGES

The present invention has been made to solve the previously described design problems of existing and proposed instruments. Accordingly, several objects and advantages of the present invention are:

(a) to provide a portable, adjustable keyboard for use in a rarity of different performance situations;

(b) to provide a keyboard that, when completely extended, may be used in a conventional manner;

(c) to provide a keyboard that, when partially extended, may be worn from the waist and hips, supported by an ergonomic belt, at the proper distance from the hands;

(d) to provide a keyboard that pivots in the middle to allow the left and right halves to be most conveniently and comfortably adjusted to the angle that the respective hands meet the keyboard;

(e) to provide a keyboard that is hinged in the middle and can be folded, for portability and stowage;

(f) to provide a keyboard that may be entirely self-contained, and may be used in a portable situation, such as marching band, or strolling performance work; and (g) to provide a keyboard that enhances the visual aspect of performance by allowing the audience to view the operational side of the keyboard.

In order to incorporate the previously described objects, according to the present invention, there is provided a centrally articulated keyboard comprising a hinged, semi-circular central pivot, and mating left and right halves with ends that may be orbited away from the operator and fixed into position at any point along the orbit. The center of the keyboard is comprised of a semi-circle of appropriate sheet plastic which is hinged in the center, each half containing a cut radial channel forming an orbit guide for each half of the keyboard, and a pivot point. When fully extended, the keyboard looks and perform in a conventional manner, and may be supported on a rack or by other appropriate means. When partially pivoted, the keyboard may be supported upon an ergonomic belt and played hanging from the front of an operator forming an inverted "V" shape, each half contouring around the performer by bending at the hinge. When fully closed, the ends of the keyboard meet, forming a handle, and the keyboard folds in the middle for stowage in a carrying bag or case.

The above objects may be achieved by manufacturing the present invention with available technology as a self-contained electronic musical instrument controller. The above objects may also be achieved by manufacturing the present invention as a mounting device, said device comprising pivoting, adjustable support members designed to accept and support small electronic keyboard controllers currently available by others.

DRAWING FIGURES

Reference Numerals in Drawings

| | | | |
|---|---|---|---|
| 10 | pivoting keyboard arms | 12 | handle |
| 14 | display/control area | 16 | pivot radius channel quide |
| 18 | hinge | 20 | hinged, semi-circular pivot assembly |
| 22 | bottom support surface | 24 | pivot points |
| 26 | speakers | 28 | MIDI and power supply jack area |
| 30 | pivot angle adjustment fasteners | 32 | clip-on belt supports |

DESCRIPTION—FIGS. 1 TO 6

Figures 1A, 1B, 1C:
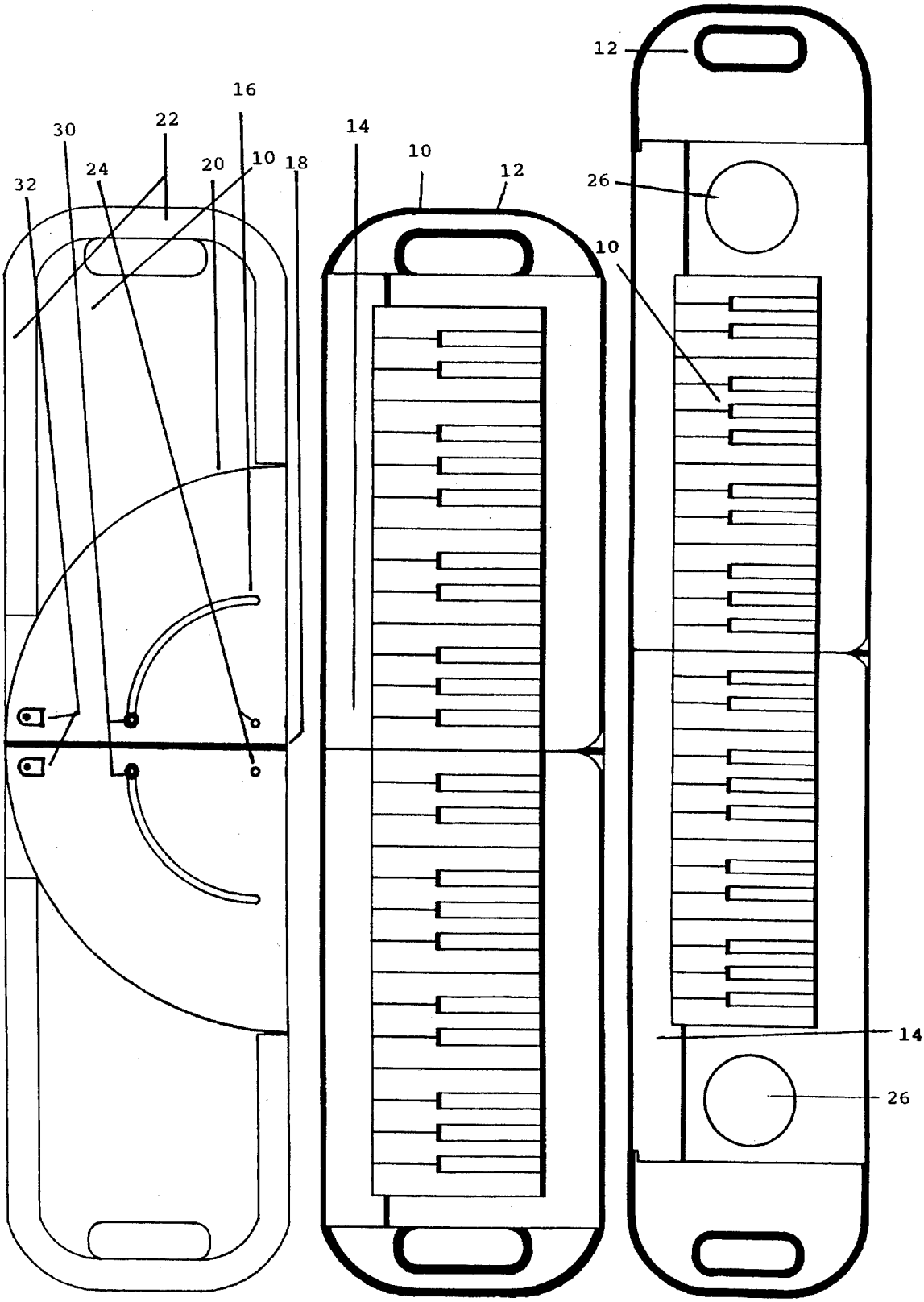
FIG. 1A shows the bottom view of the keyboard controller in a fully extended position.
FIG. 1B shows the top view of the keyboard controller in a fully extended position.
FIG. 1C shows the top view of the self-contained keyboard controller with speakers, fully extended.
Figure 2:
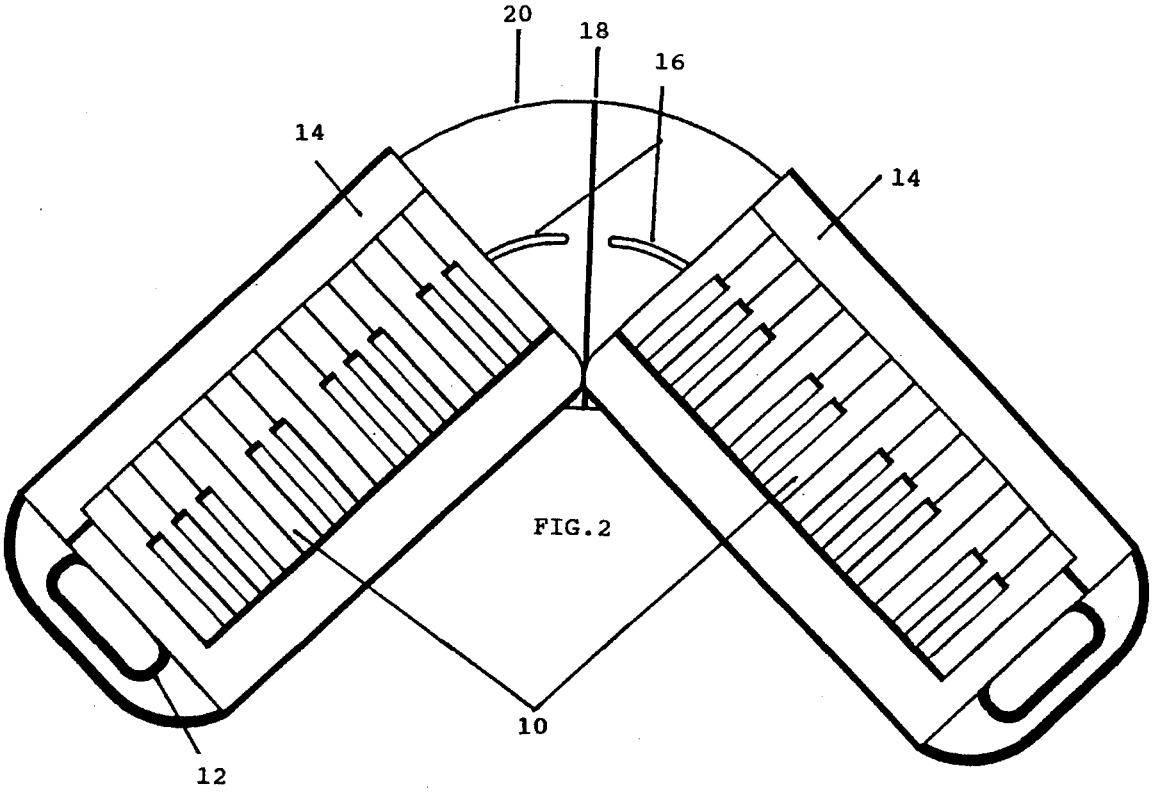
FIG. 2 shows the keyboard in a partially pivoted position, easily supported from the waist.
Figure 4:
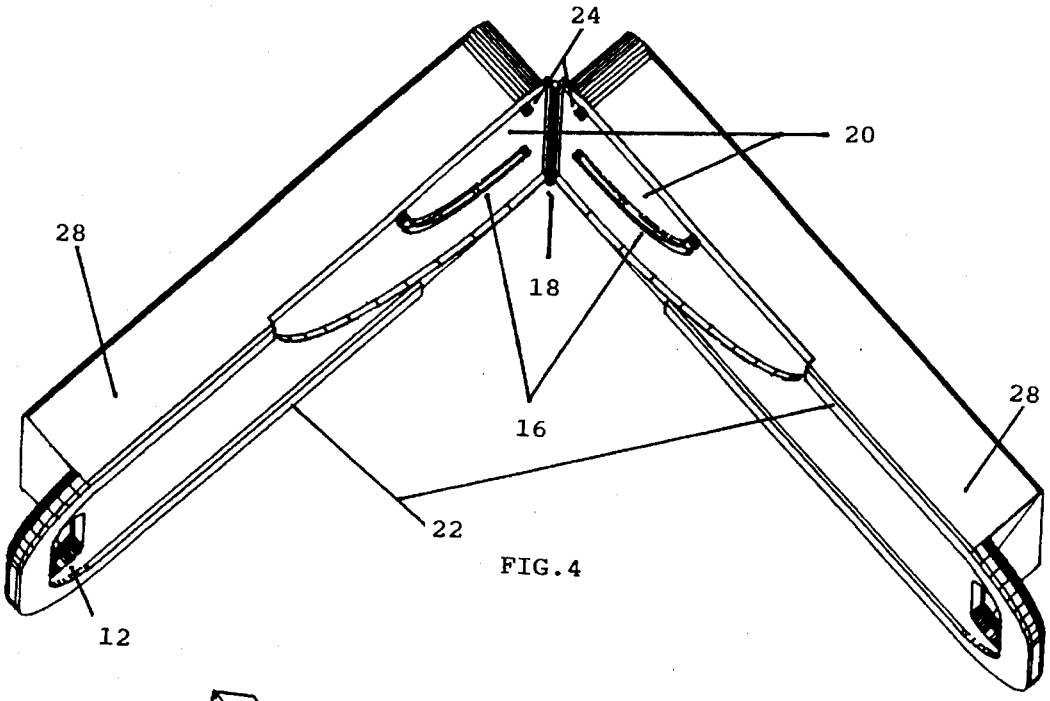
FIG. 4 shows the lower, rear view of the keyboard in a partially folded position.
Figure 5:
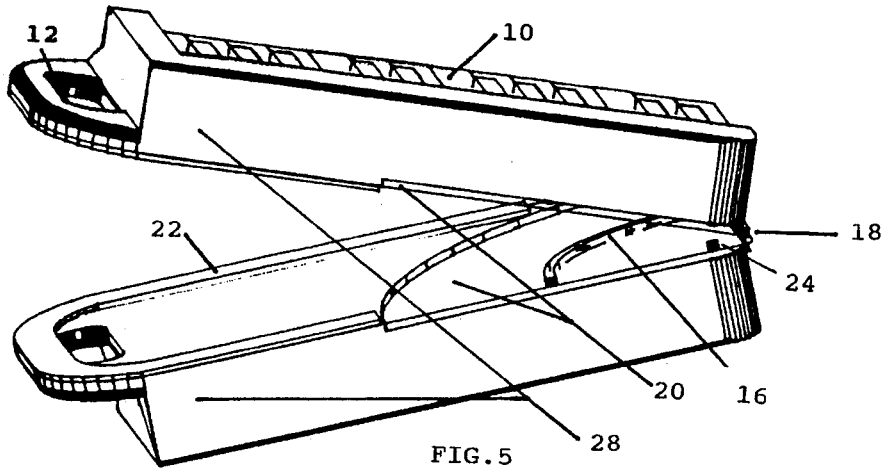
FIG. 5 shows the lower, rear view of the keyboard folded at the hinge, almost completely closed.

A typical embodiment of the versatility of the present invention is illustrated in FIG. 2 (top view) and FIG. 4 (bottom,rear view), comprising the hinged, semi-circular pivot assembly 20. Each keyboard arm 10 may be independently adjusted for ease of playing when being supported at the waist. This is accomplished by adjusting the fasteners (FIG. 1A) 30 at the pivot radius channels 16.

When supported at the waist by an ergonomic belt or other appropriate means, the keyboard bends in the middle at the hinge 18 allowing each half of the keyboard to more comfortably contour to the body. The keyboard is supported from a belt by means of clip-on belt supports 32, or support holes.

All control information is available at the display/control area (FIG. 1,3,4) 14. Of special consideration is the angled face of the display area that allows information to be communicated in traditional and waist supported modes of performance.

The ends 12 of the keyboard fold together to form a convenient carrying handle, and to aid in removal from a carrying bag.

There are various possibilities with regard to the relative playing position of one keyboard arm to another as shown in FIGS. 1, 2, 3, and 6; such that a performer is no longer limited to playing a keyboard controller in a conventional manner.

From the description above, a number of advantages of the present invention keyboard become evident:

(A) The folding nature of this keyboard allows portability that was previously unattainable, and performance flexibility unmatched with present market technology.

(b) The ability to utilize a keyboard controller in a new manner allows the performer freedom from the encumberences of keyboard racks, and multiple keyboards. With all control information at the fingertips of the operator, keyboard players may now step out in front of their equipment and become more interactive members during performance.

(C) The use of self-contained rechargeable batteries and a MIDI transmitter allow for a cord-free performance, and add to the versatility of this keyboard.

(d) The self-contained keyboard controller may be used anywhere, including, but not limited to half-time shows and parades for marching bands, street musicians, stage shows, and all live performances.

(d) The unique inverted "V" shape of this keyboard when it is worn at the waist adds to the excitement and mystique of a live performance, and allows performance freedom never before experienced.

OPERATIONS—FIGS.

The manner of using this split-keyboard controller is identical to that of keyboards in present use. Namely, one presses upon the various keys to send meaningful control data to an internal sound source, or to an external sound source via MIDI, or other suitable means.

Figure 3:
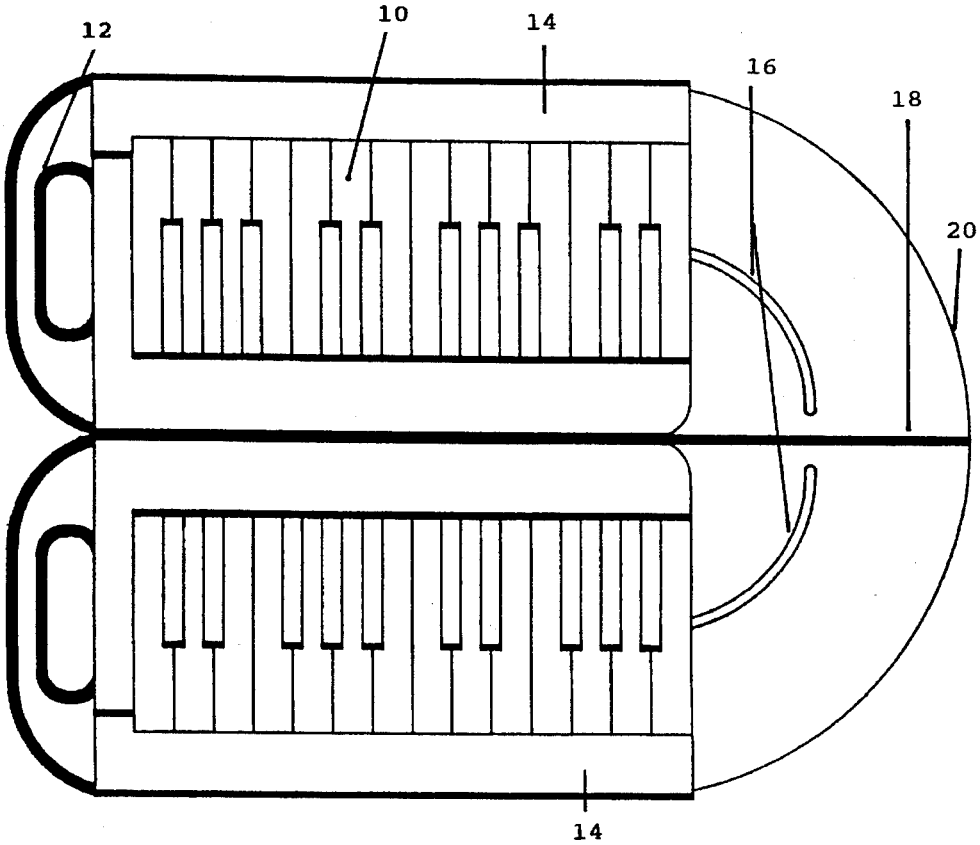
FIG. 3 shows the keyboard in a fully pivoted position, exposing the center semi-circular pivot.
Figure 6:
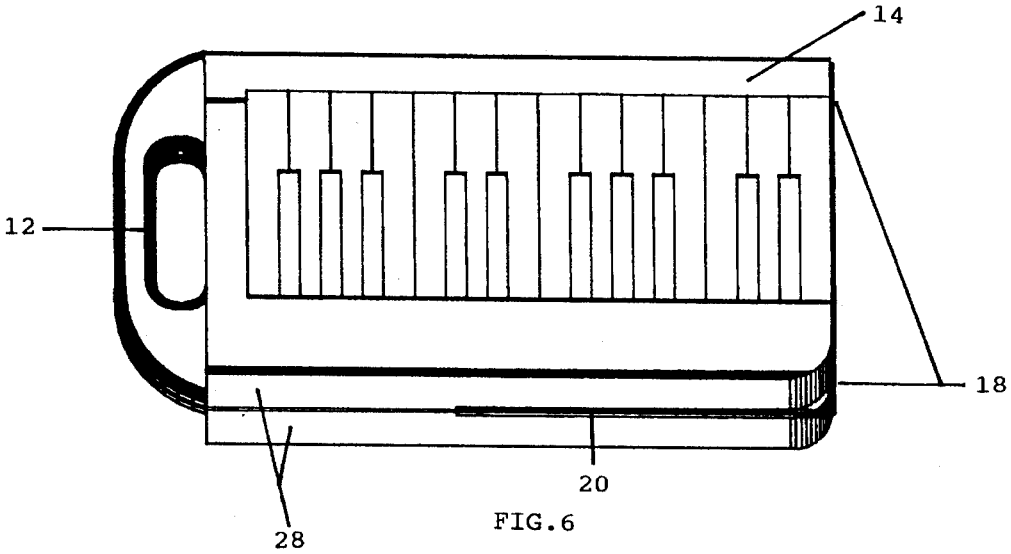
FIG. 6 shows the lower, side view of the keyboard in a closed position, ready for travel or stowage.

The advantages come from the versatility offered the performer. One may set this keyboard upon a conventional support, playing it in a traditional manner (FIG. 1). One may adjust the angle of the left and right halves of the keyboard obtusely to each other when supporting the device from a belt or stand (FIG. 2). The keyboards may be played back-to-back in an accordian fashion (FIG. 3). The left and right halves of the split-keyboard controller fold bottom-to-bottom, effectively reducing the length of the keyboard by half (FIG. 6).

SUMMARY, RAMIFICATIONS, AND SCOPE

Accordingly, the reader will see that the splitting and folding nature of this keyboard can allow the keyboard to be used in a conventional manner, can allow the keyboard to be played supported from the waist by appropriate means, can allow for individualized, independent adjustment of the playing angle, and can fold in half for convenient transportation or stowage. In addition, the keyboard may be entirely self-contained, enhancing to versatility and usefulness.

Although the description above contains many specifications, these should not be construed as limiting the scope of the invention but merely as providing illustrations of some of the presently preferred embodiments of this invention. For example, the keyboard arms could have other shapes, such as oval, triangular, trapezoidal, teardrop, etc; the hinged pivot can have other shapes; the radial channels can be replaced with a locking pin and hole assembly, etc. In addition, the plastic can be replaced by other suitable materials, the clip-on belt supports can be replaced with holes designed to engage posts on the belt, etc.

Thus the scope of the invention should be determined by actual application, and the appended claim and their legal equivalents, rather than by the examples given.

I claim:

1. In a keyboard controller of the type comprising a set of keys which corresponds with a common piano and a means for translating pressure on said keys into meaningful control data, the improvement wherein said keyboard controller has means to pivot acutely in the center such that the playing surfaces that comprise the left and right halves of said keyboard controller may adjust from continuously linear to acutely parallel, away from an operator, forming a variable split-keyboard controller.

2. The keyboard controller of claim 1 wherein said pivot adjusts to individual preference, comfort, and ease of use.

3. The keyboard controller of claim 1 wherein the left and right halves of said keyboard controller fold bottom-to-bottom along a central hinged articulation means, for compact portability.

4. The keyboard controller of claim 1 wherein the body of said keyboard controller may be manufactured in a multiplicity of primary and secondary colors such that said keyboard controller may be immediately recognized and differentiated from other prior art keyboard controllers.

5. The sets of keys of the keyboard controller of claim 1 wherein said keys may be manufactured in a multiplicity of primary or secondary colors, lending originality and instantly recognizable individuality to any specific said split keyboard controller.

6. The keyboard controller of claim 1 wherein said left and right halves of said keyboard controller have a program and display means beneath the keys such that said program/display means may be seen and accessed from any playing position.

7. The keyboard controller of claim 1 wherein the body of said keyboard controller may be supported upon, or suspended from an ergonomic belt, suspender-type support harness, prior art guitar straps, or other appropriate support means.

8. The keyboard controller of claim 1 wherein said keyboard controller may be pivoted such that said keys of said keyboard controller are in a continuous parallel line perpendicular and centered to an operator of said keyboard controller, forming a conventional keyboard device.

9. The keyboard controller of claim 1 where said keyboard controller may be self-supporting in a conventional manner, upon any surface appropriate to support said keyboard controller.

10. The keyboard controller of claim 1 wherein each end of said keyboard controller is shaped such that a carrying means is formed when said keyboard controller is folded acutely such that said ends of said keyboard controller meet.

11. The keyboard controller of claim 1 wherein said keyboard controller may be self-sufficient, comprising a sound source and speakers, rechargeable batteries and charging means, and sequencing and recording means, with appropriate software storage means.

12. The keyboard controller of claim 11 wherein said keyboard controller may be designed to a smaller size for children.

13. The keyboard controller of claim 1 wherein said keyboard controller may be remotely used, comprising a wireless data transmission means to a remote sound source.

14. The keyboard controller of claim 1 wherein the opposing ends of said keyboard controller may be pivoted accutely such that said left and right playing surfaces are back-to-back and perpendicular to the ground, covering the chest of an operator.

* * * * *